US010676853B2

(12) United States Patent
Xu et al.

(10) Patent No.: US 10,676,853 B2
(45) Date of Patent: Jun. 9, 2020

(54) FRONT-LOADING WASHING MACHINE AND UNBALANCE DETECTION METHOD AND DEVICE THEREOF

(71) Applicant: GUANGDONG WELLING MOTOR MANUFACTURING CO., LTD., Foshan (CN)

(72) Inventors: Lei Xu, Foshan (CN); Liming Gong, Foshan (CN); Xiangnan Qin, Foshan (CN)

(73) Assignee: GUANGDONG WELLING MOTOR MANUFACTURING CO., LTD., Foshan, Guangdon (CN)

( * ) Notice: Subject to any disclaimer, the term of this patent is extended or adjusted under 35 U.S.C. 154(b) by 220 days.

(21) Appl. No.: 15/882,822

(22) Filed: Jan. 29, 2018

(65) Prior Publication Data

US 2018/0148880 A1 May 31, 2018

Related U.S. Application Data

(63) Continuation of application No. PCT/CN2015/085696, filed on Jul. 31, 2015.

(51) Int. Cl.
*D06F 37/42* (2006.01)
*D06F 37/20* (2006.01)
(Continued)

(52) U.S. Cl.
CPC ..... *D06F 37/42* (2013.01); *D06F 33/00* (2013.01); *D06F 35/007* (2013.01);
(Continued)

(58) Field of Classification Search
CPC ..... D06F 33/02; D06F 37/007; D06F 37/42; D06F 37/203; D06F 39/002;
(Continued)

(56) References Cited

U.S. PATENT DOCUMENTS 4,765,161 A * 8/1988 Williamson ..... D06F 37/203 68/12.06
6,282,965 B1 * 9/2001 French ..... D06F 37/203 68/23.1

(Continued)

FOREIGN PATENT DOCUMENTS

CN 104452187 A * 3/2015
DE 198 41 245 A1 4/1999
JP 2006-325839 A 12/2006

OTHER PUBLICATIONS

Machine translation of CN-104452187-A to Gong et al. (Year: 2015).*

(Continued)

*Primary Examiner* — Joseph L. Perrin
(74) *Attorney, Agent, or Firm* — Scully Scott Murphy & Presser

(57) ABSTRACT

The present disclosure relates to a front-loading washing machine and an unbalance detection method and device thereof. The method comprises: when a drum operates at a low constant speed, detecting the torque of the drum and acquiring average torque values; when the roller operates at a constant acceleration speed, acquiring average torque values and a minimum value of the average torque values of the drum in real time; determining whether a difference between the average torque and the minimum value of the average torque values is greater than a preset unbalance threshold; and if so, determining that dynamic unbalance occurs on the drum; otherwise determining that no dynamic unbalance occurs on the drum. Because no sensor is needed for unbalance detection, cost and the detection difficulty are lowered, and damages to mechanical components due to collisions caused by dynamic unbalance when the drum operates at a high speed is avoided.

3 Claims, 8 Drawing Sheets

(51) Int. Cl.
*D06F 33/00* (2020.01)
*D06F 35/00* (2006.01)

(52) U.S. Cl.
CPC ..... *D06F 37/203* (2013.01); *D06F 2202/12* (2013.01); *D06F 2204/065* (2013.01); *D06F 2220/00* (2013.01); *D06F 2222/00* (2013.01)

(58) Field of Classification Search
CPC ..... D06F 39/003; D06F 2202/12; D06F 2204/065; D06F 2220/00; D06F 2222/00
See application file for complete search history.

(56) References Cited

U.S. PATENT DOCUMENTS 6,381,791 B1 * 5/2002 French ..... D06F 37/203 68/12.02
6,715,175 B2 * 4/2004 Ciancimino ..... D06F 33/02 68/12.06
2004/0211009 A1 * 10/2004 Murray ..... D06F 35/007 8/159
2005/0204482 A1 * 9/2005 Murray ..... D06F 33/02 8/158
2005/0284192 A1 * 12/2005 Altinier ..... D06F 35/007 68/12.06
2006/0238152 A1 * 10/2006 Marioni ..... D06F 37/203 318/268
2010/0306926 A1 * 12/2010 Altinier ..... D06F 37/203 8/137
2014/0215725 A1 * 8/2014 Paglia ..... D06F 35/007 8/137
2015/0134125 A1 5/2015 Dedow et al.

OTHER PUBLICATIONS

Search Report dated Dec. 30, 2019 received in Brazil Patent Application No. BR 112018001925-9 together with an English language translation.

* cited by examiner

FRONT-LOADING WASHING MACHINE AND UNBALANCE DETECTION METHOD AND DEVICE THEREOF

PRIORITY CLAIM AND RELATED APPLICATION

This application is a continuation application of PCT/CN2015/085696, entitled "FRONT-LOADING WASHING MACHINE AND UNBALANCE DETECTION METHOD AND DEVICE THEREOF" filed on Jul. 31, 2015, which is incorporated herein by reference in its entirety, which is incorporated herein by reference in their entirety.

TECHNICAL FIELD

The present disclosure relates to a technical field of detection and control for washing machines, and more particularly to a front-loading washing machine and an unbalance detection method and an unbalance detection device thereof.

BACKGROUND

As for a front-loading washing machine, when a drum driven by a variable frequency motor is unbalanced, the higher a rotation speed of the variable frequency motor is, the larger vibration and noise of the system are, thereby reducing service life of the front-loading washing machine. The variable frequency motor has load unbalance detection function, when a load such as the drum is found to be unbalanced, the vibration and noise of the system can be reduced by adjusting the rotation speed or changing the unbalanced state of the load.

The two conventional unbalance detection methods are as follows:

(1) A sensor can be adopted to detect whether the drum is balanced or not, however the sensor has high cost and is not easy to mount, thereby resulting in a high detection difficulty.

(2) Whether the drum is balanced or not can be judged according to the rotation speed or torque of the variable frequency motor during a low-speed operation phase and a high-speed operation phase. However, this method cannot achieve a dynamic unbalance detection while performing a static unbalance detection of the drum during the low-speed operation phase (the motor operates at a constant rotation speed). Since the drum operates at a high speed during the high-speed operation phase, performing the dynamic unbalance detection during the high-speed operation can make mechanical components inside the washing machine collide, resulting in damage to the washing machine.

From the above, there are problems in the prior art that cost is high, detection difficulty is high, the dynamic unbalance detection of the drum cannot be performed during the low-speed operation phase, and performing the dynamic unbalance detection during the high-speed operation will make the mechanical components inside the washing machine collide, resulting in damage to the washing machine.

SUMMARY

An objective of the present disclosure is to provide an unbalance detection method for a front-loading washing machine, seeking to solve the problems existing in the prior art that cost is high, detection difficulty is high, a dynamic unbalance detection of a drum cannot be performed during a low-speed operation phase, and performing a dynamic unbalance detection during a high-speed operation will make mechanical components inside the washing machine collide, resulting in damage to the washing machine.

The present disclosure is achieved by an unbalance detection method for a front-loading washing machine, the unbalance detection method including the following steps of:

A. during an accelerative operation of the drum according to a constant acceleration, detecting a torque of the drum and acquiring a torque average value and a minimum value of the torque average value in a period of per rotation that the drum completes; and B. judging whether a difference value between the torque average value and the minimum value of the torque average value is greater than a preset unbalance threshold value, if the difference value is greater than the preset unbalance threshold value, determining that dynamic unbalance appears in the drum, otherwise determining that no dynamic unbalance appears in the drum.

The present disclosure also provides an unbalance detection device for a front-loading washing machine, the unbalance detection device including: a torque average value acquiring module and a dynamic unbalance judging module; the torque average value acquiring module detecting a torque of a drum and acquiring a torque average value and a minimum value of the torque average value in a period of per rotation that the drum completes during an accelerative operation of the drum at a constant acceleration; the dynamic unbalance judging module being configured to judge whether a difference value between the torque average value and the minimum value of the torque average value is greater than a preset unbalance threshold value, if the difference value is greater than the preset unbalance threshold value, determining that dynamic unbalance appears in the drum, otherwise, determining that no dynamic unbalance appears in the drum.

The present disclosure further provides a front-loading washing machine, including a drum and the above-mentioned unbalance detection device for the front-loading washing machine.

During the process of performing the unbalance detection of the front-loading washing machine, when the drum operates at a low constant speed, the torque of the drum is detected and the torque average value is acquired according to the present disclosure. And then when the drum is accelerated according to the constant acceleration, the torque average value of the drum and the minimum value thereof are acquired in real time, and that whether dynamic unbalance appears in the drum is judged according to the torque average value and the minimum value of the torque average value, if yes, the drum is controlled to stop accelerative operation, meanwhile that whether the number of times of the shake-disperse operations which have been performed by the drum is greater than the preset number of times is judged, if yes, the drum is controlled to stop operating, otherwise, the drum is controlled to perform the shake-disperse operation and operate at the low speed subsequently, and the static unbalance detection is performed when the drum operates at the low speed. During this process, there is no need to perform the unbalance detection by a sensor, reducing the cost and detection difficulty, and the dynamic unbalance detection can be performed when the drum is in the low speed operation and the accelerative operation, avoiding the damages to the mechanical components due to collision caused by the dynamic unbalance detection when the drum operates at the high speed.

DETAILED DESCRIPTION

In order to make the objective, technical solutions and advantages of the present disclosure more explicit and clear, the present disclosure will be further described in details in combination with drawings and embodiments in below. It should be understood that, the specific embodiments described herein are just used to explain the present disclosure, and should not be used to limit the present disclosure.

Figure 1:
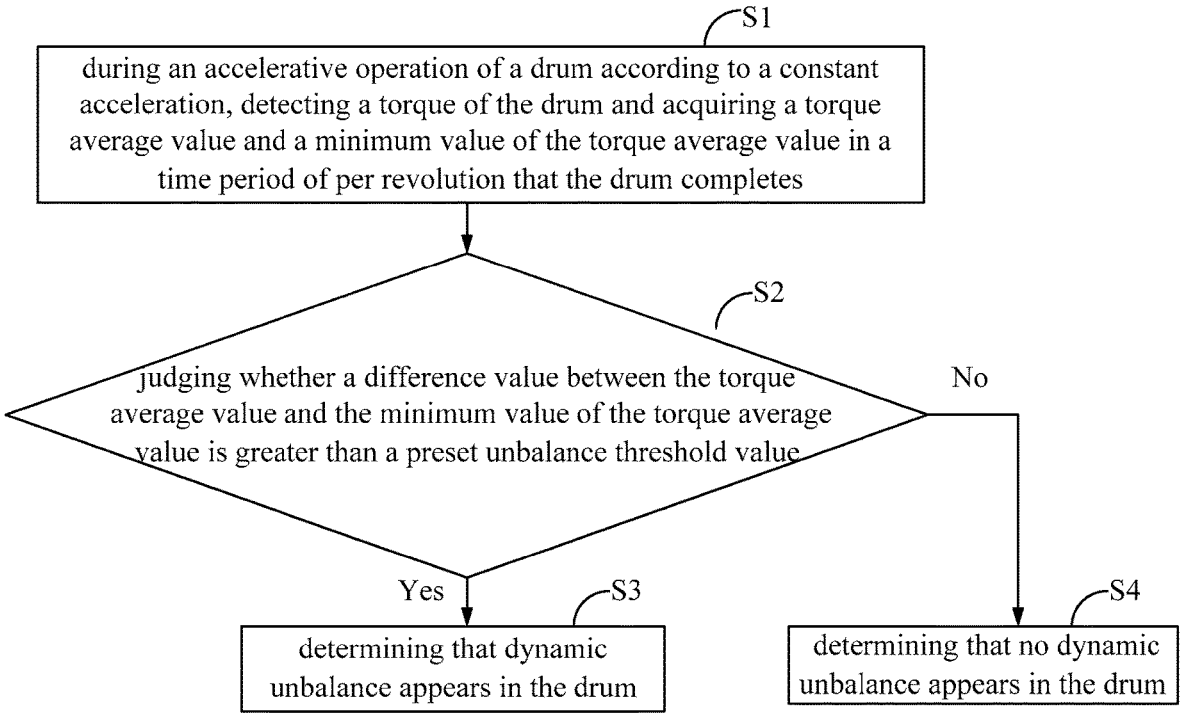
FIG. 1 is a flow chart for implementing an unbalance detection method for a front-loading washing machine according to embodiments of the present disclosure.

FIG. 1 illustrates an implementation process of an unbalance detection method for a front-loading washing machine according to embodiments of the present disclosure, and for convenience of description, it just shows parts related to embodiments of the present disclosure, which is elaborated as follows.

In a step S1, during an accelerative operation of a drum at a constant acceleration, a torque of the drum is detected, so as to acquire a torque average value and the minimum value of the torque average value during the period of per rotation that the drum completes.

The step of detecting the torque of the drum and acquiring the torque average value in the above-mentioned step S1 specifically includes the following steps.

The torque of the drum is detected in real time during the period of per rotation that the drum completes, and the torque average value is acquired according to a plurality of detected torque values and the time of one rotation.

It should be noted herein that the torque average value can be acquired by integrating the plurality of torque values and dividing it by the time of one rotation.

The step of acquiring the minimum value of the torque average value of the drum in real time in the above-mentioned step S1 is specifically as follows.

That whether the torque average value is greater than a pre-recorded minimum value of the torque average value is judged, if the result is yes, the pre-recorded minimum value of the torque average value is set as the minimum value of the torque average value, and if the result is no, the torque average value is set as the minimum value of the torque average value.

It should be noted that at the beginning, a torque average value is set as the minimum value of the torque average value and is recorded, when the drum completes another one rotation and another torque average value is acquired, the torque average value is compared with the recorded minimum value of the torque average value, and the minimum value will be updated according to the comparison value, therefore once the drum completes one rotation, the torque average value and the minimum value of the torque average value can be acquired.

In a step S2, that whether a difference value between the torque average value and the minimum value of the torque average value is greater than a preset unbalance threshold value is judged, if the result is yes, a step S3 is performed, and if the result is no, a step S4 is performed.

In the step S3, it is determined that dynamic unbalance appears in the drum.

In the step S4, it is determined that no dynamic unbalance appears in the drum.

In this case, after the step S4, the drum can be controlled to continue to operate according to a preset washing procedure, in which, the preset washing procedure can be a high-speed spinning operation performed by the front-loading washing machine after the washing operation is completed.

Figure 2:
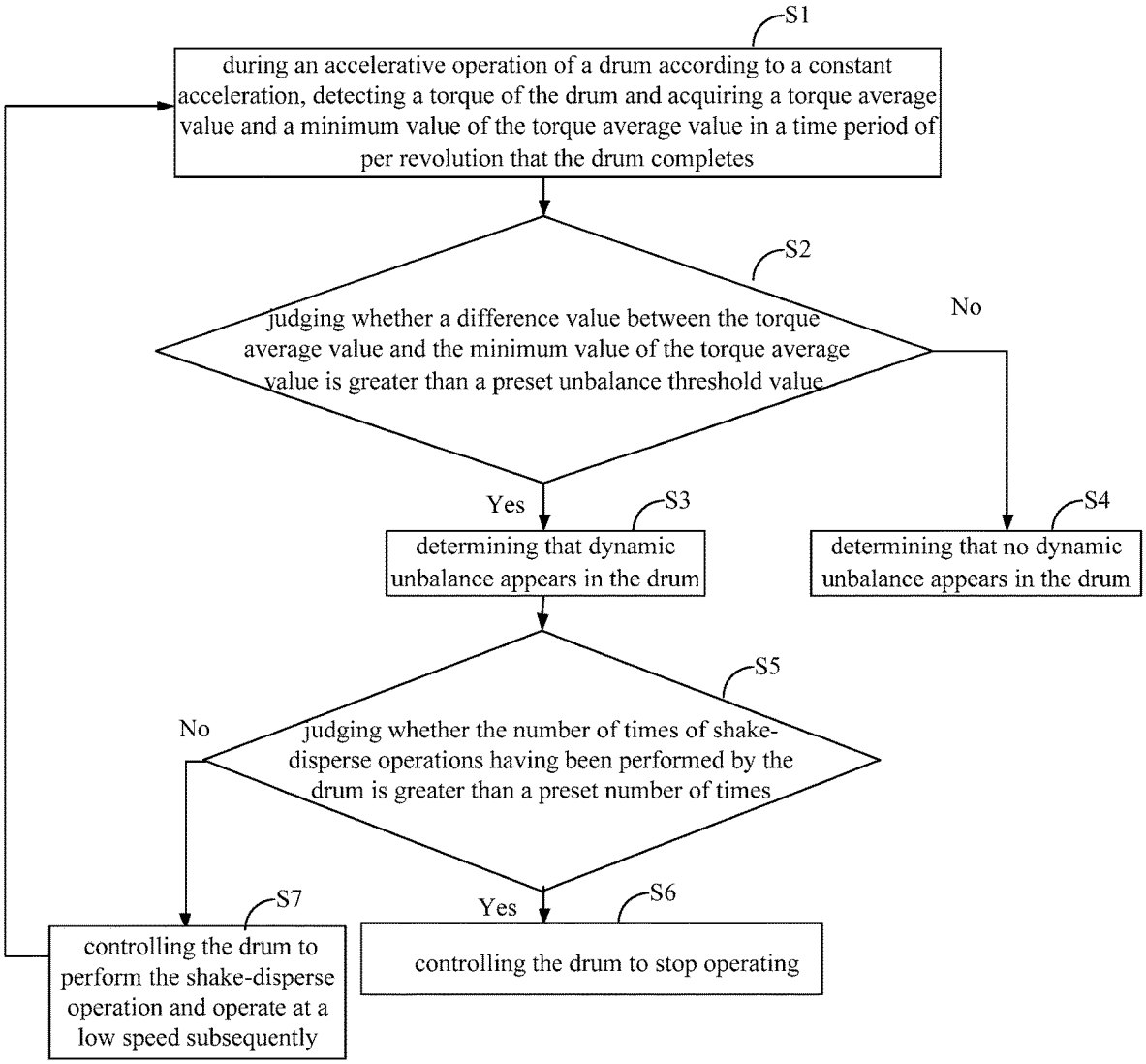
FIG. 2 is another flow chart for implementing an unbalance detection method for a front-loading washing machine according to embodiments of the present disclosure.

Furthermore, as shown in FIG. 2, the following steps can be provided after the step S3.

In the step S5, that whether the number of times of completed shake-disperse operations performed by the drum is greater than a preset number of times, if the result is yes, the step S6 is performed, and if the result is no, the step S7 is performed.

In the step S6, the drum is controlled to stop operating.

In the step S7, the drum is controlled to perform the shake-disperse operation and operates at a low speed subsequently, and then the step S1 is performed by returning back.

The shake-disperse operation refers to an operation that the drum shakes under the control of an electric motor, such that the current laundry accommodated in the drum can be dispersed uniformly, the drum can recover the balance by performing the shake-disperse operation. The preset number of times refers to a preset number of times of the shake-disperse operation. The preset number of times is used to determine whether the shake-disperse operations performed by the front-loading washing machine have reached the specific number of times, if the result is yes, it is indicated that the dynamic unbalance of the drum cannot be solved by performing the shake-disperse operation, and the drum needs to stop operating, so as to avoid components in the front-loading washing machine from being damaged; if the result is no, the drum can be controlled to perform the shake-disperse operation, so as to make the drum recover the balance.

Figure 3:
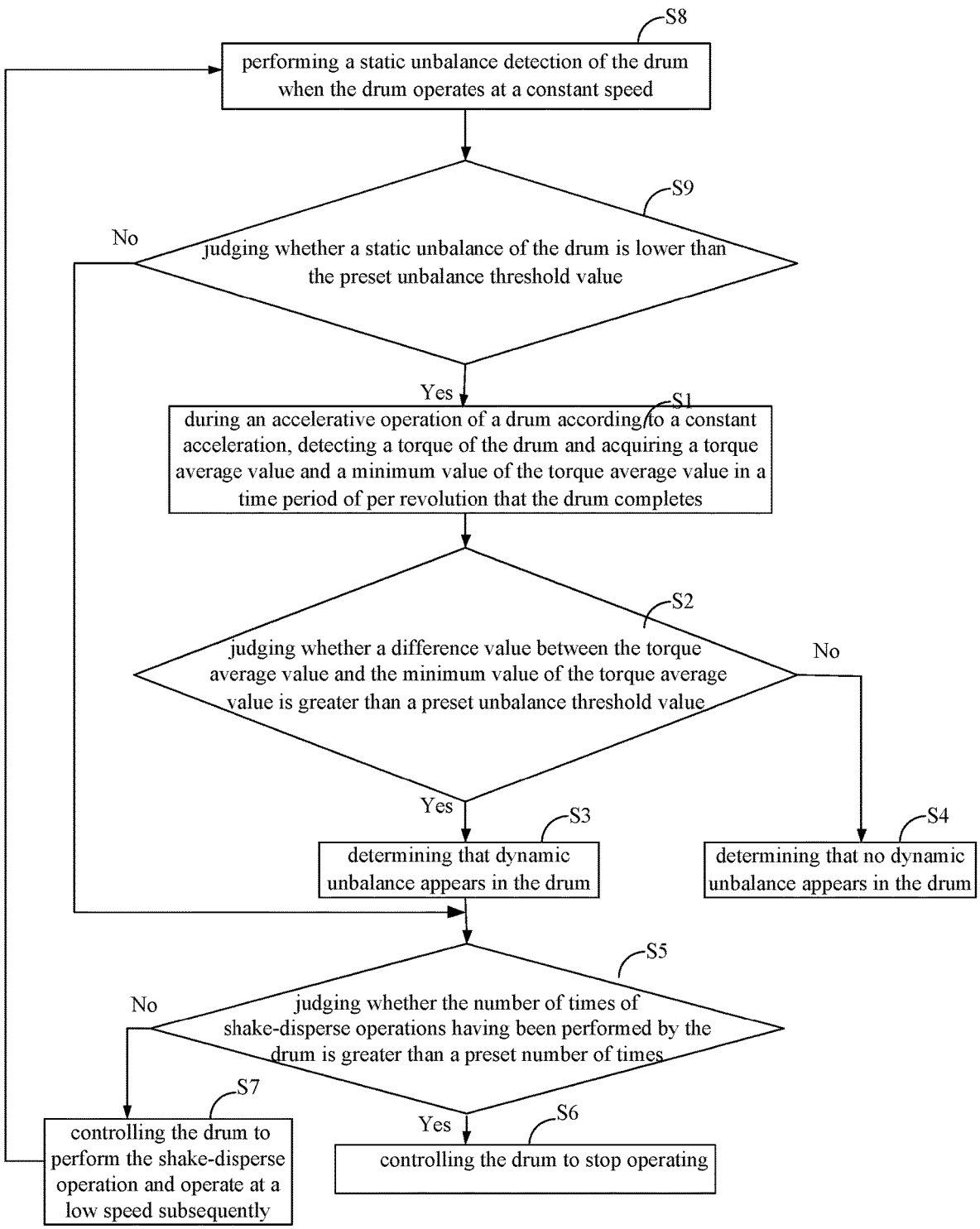
FIG. 3 is another flow chart for implementing an unbalance detection method for a front-loading washing machine according to embodiments of the present disclosure.

In addition, as shown in FIG. 3, the following steps are further provided before the step S1.

In a step S8, a static unbalance detection on the drum is performed when the drum operates at a constant speed.

In a step S9, that whether the static unbalance of the drum is lower than the preset unbalance threshold value is judged, if the result is yes, the step S1 is performed, and if the result is no, the step S5 is performed.

It can be seen from this, when the static unbalance appears in the drum, the drum can also be controlled to perform the shake-disperse operation to recover the balance, the operation processes are the same as the steps S5 to S7, which will not elaborated again.

In addition, in another embodiment, in the step S7, the drum is controlled to perform the shake-disperse operation and operate at a low speed subsequently, and then the step S8 is performed by returning back.

The above-mentioned unbalance detection method for the front-loading washing machine will be further described in combination with the following specific embodiments.

Assuming the rotation speed of the drum operating at the low speed is 90 rpm (rotations per minute), the process of the accelerative operation according to the constant acceleration is from 90 rpm to 220 rpm. During the process that the drum is accelerated according to the constant acceleration from 90 rpm to 220 rpm, the torque average value and the minimum value of the torque average value of the drum can be acquired in real time. Specifically, the torque of the drum is detected during the period of per rotation that the drum completes, and a torque average value A is acquired according to the detected torques, and the torque average value is compared with a recorded minimum value of the torque average value, so as to acquire a new minimum value B of the torque average value. Then whether the dynamic unbalance appears in the drum can be judged according to the torque average value A and the minimum value B of the torque average value. During this judging process a difference value C (i.e., C=B−A) between the minimum value B of the torque average value and the torque average value A are acquired by performing subtraction. And then that whether the difference value C is greater than a preset fluctuation threshold value X is judged, if the result is yes, it is determined that that the dynamic unbalance appears in the drum, and if the result is no, it is determined that no dynamic unbalance appears in the drum. When the dynamic unbalance appears in the drum, the drum is controlled to stop accelerative operation, so as to reduce damages to mechanical components in the washing machine due to collision, meanwhile that whether the number of times of the completed shake-disperse operations performed is greater than a preset number of times Y is judged, if the result is yes, it is indicated that the drum cannot recover the balance by performing the shake-disperse operation, and needs to be controlled to stop operating immediately, so as to avoid the mechanical components in the front-loading washing machine from further collision and abrasion; if the result is no, the drum can be controlled to perform the shake-disperse operation, so as to make the drum recover the balance, and the static unbalance detection on the drum can be continuously performed when the drum operates at the low speed. When no dynamic unbalance appears in the drum, according to the preset washing procedure (such as high-speed spinning procedure), the drum can be controlled to operate at the high speed of 220 rpm, so as to continue the spinning operation of the laundry.

In addition, when performing the static unbalance detection of the drum, if the static unbalance of the drum exceeds the specific threshold value, that whether the number of times of the completed shake-disperse operations is greater than the preset number of times Y, if the result is yes, it is indicated that the drum cannot recover the balance by performing the shake-disperse operation, and needs to be controlled to stop operating immediately, so as to avoid the mechanical components in the front-loading washing machine from further collision and abrasion; if the result is no, the drum can be controlled to perform the shake-disperse operation, so as to make the drum recover the balance, and the static unbalance detection of the drum can be continuously performed when the drum operates at the low speed.

By adopting the above-mentioned unbalance detection method for the front-loading washing machine, the dynamic unbalance detection can be performed when the drum is in the accelerative operation, avoiding damages to mechanical components due to collision caused by the dynamic unbalance detection when the drum operates at the high speed. In the practical application, when performing the unbalance detection of the drum, according to different load weights (empty drum, 30% load, 50% load, and 80% load), the detection results are as follows.

Figure 4:
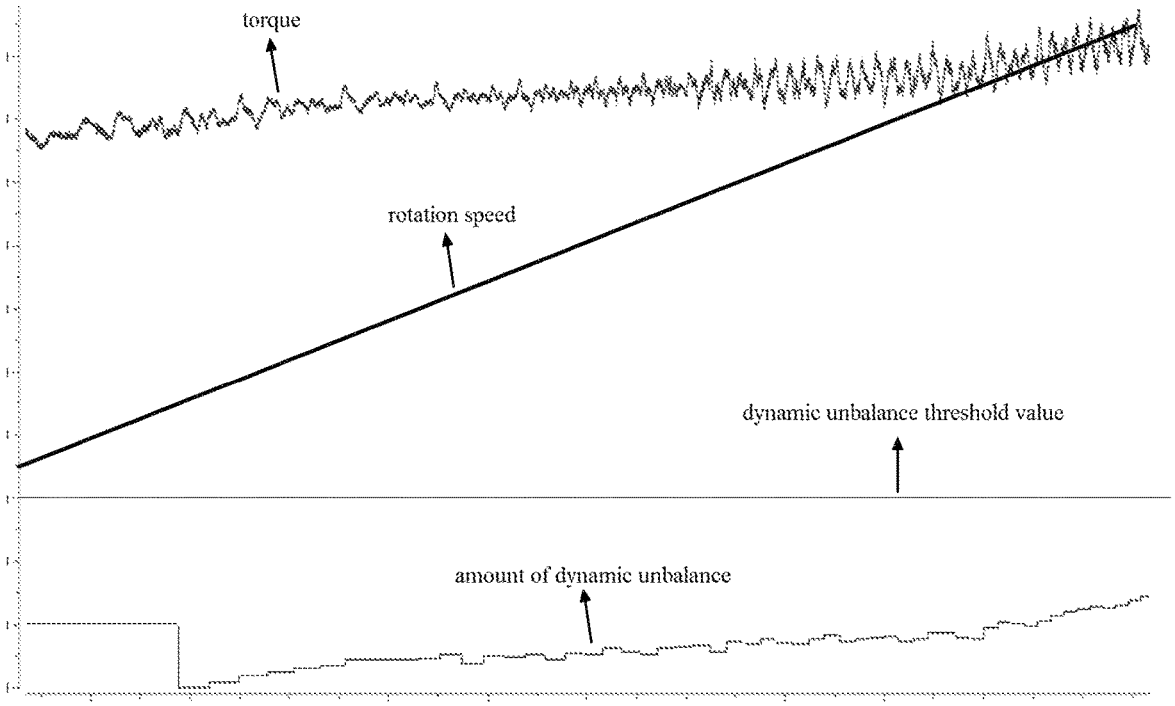
FIG. 4 is a waveform chart of variations of parameters related to an unbalance detection method for a front-loading washing machine according to embodiments of the present disclosure.

In the first case, the drum is empty with balance load. FIG. 4 illustrates waveforms of a speed command, a real-time torque and the amount of the dynamic unbalance during an acceleration process of the drum. With the increasing rotation speed, the torque is slightly pumped up, and the amount of the dynamic unbalance cannot reach the set dynamic unbalance threshold value. It can continue to accelerate the drum to the high-speed phase, and the test result is in conformity with the design expectation.

Figure 5:
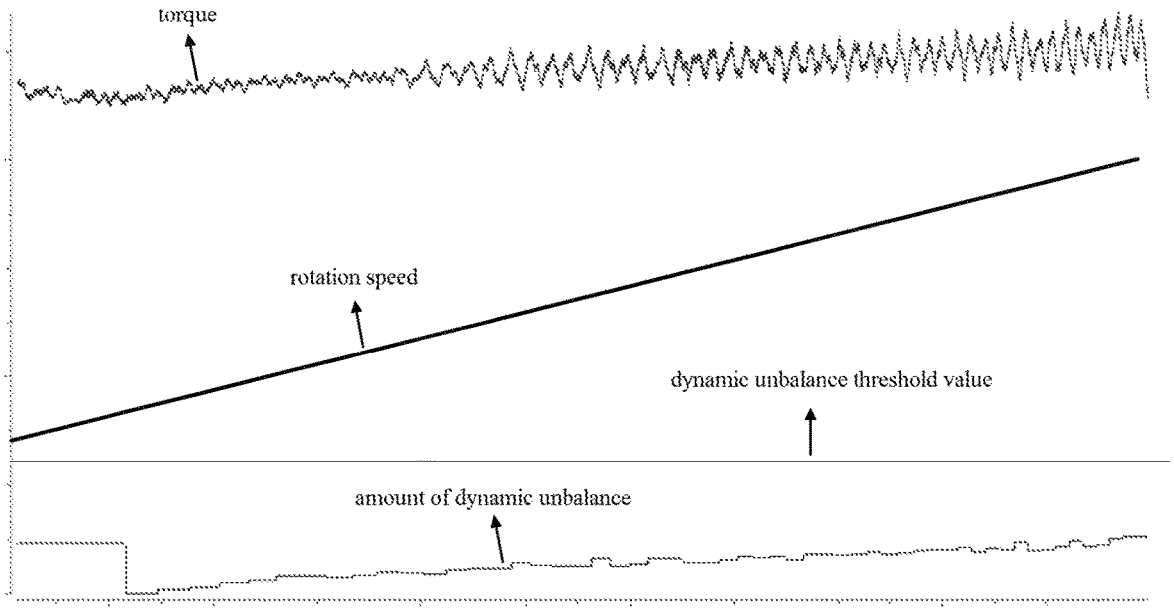
FIG. 5 is a waveform chart of variations of parameters related to an unbalance detection method for a front-loading washing machine according to embodiments of the present disclosure.

In the second case, the drum bears 30% balance load. As shown in FIG. 5, compared with the case of empty drum, the torque is wholly increased, however the amounts of the torques which are pumped up during the acceleration process are close to each other, and the amount of the dynamic unbalance cannot reach the set dynamic unbalance threshold value. It can continue to accelerate the drum to the high-speed phase, and the test result is in conformity with the design expectation.

Figure 6:
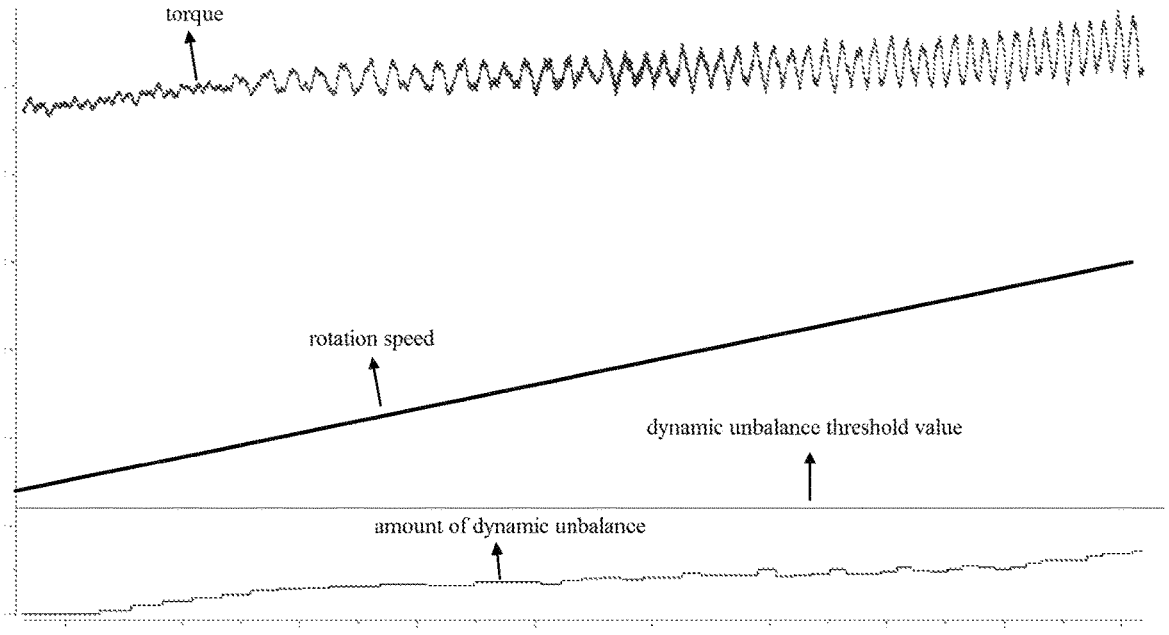
FIG. 6 is a waveform chart of variations of parameters related to an unbalance detection method for a front-loading washing machine according to embodiments of the present disclosure.

In the third case, the drum bears 50% balance load. As shown in FIG. 6, compared with the cases of empty drum and the 30% averaged load, the torque is wholly increased, however the amounts of the torques which are pumped up during the acceleration process are close to each other, and the amount of the dynamic unbalance cannot reach the set dynamic unbalance threshold value. It can continue to accelerate the drum to the high-speed phase, and the test result is in conformity with the design expectation.

Figure 7:
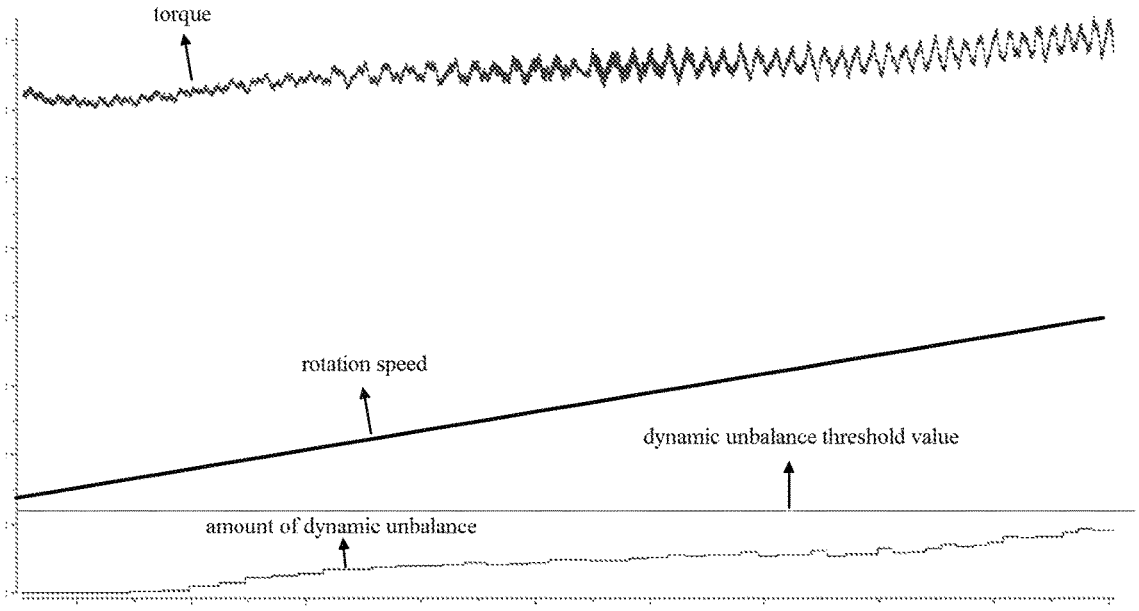
FIG. 7 is a waveform chart of variations of parameters related to an unbalance detection method for a front-loading washing machine according to embodiments of the present disclosure.

In the fourth case, the drum bears 80% balance load. As shown in FIG. 7, compared with the cases of empty drum, the 30% averaged load and the 50% averaged load, the torque is wholly increased, however the amounts of the torques which are pumped up during the acceleration process are close to each other, and the amount of the dynamic unbalance cannot reach the set dynamic unbalance threshold value. It can continue to accelerate the drum to the high-speed phase, and the test result is in conformity with the design expectation.

Detection results of the balance load state and the dynamic unbalance load state are verified to include four following conditions.

Figure 8:
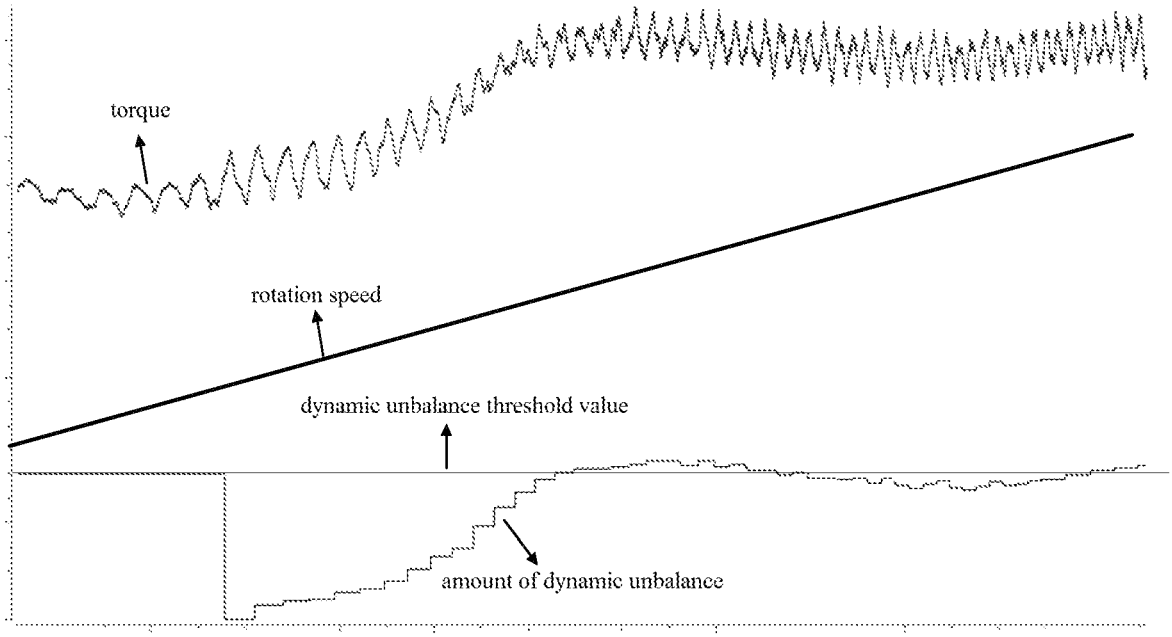
FIG. 8 is a waveform chart of variations of parameters related to an unbalance detection method for a front-loading washing machine according to embodiments of the present disclosure.

The first condition is that the drum satisfies the dynamic unbalance load state (empty drum, 800 g diagonal eccentricity). FIG. 8 illustrates waveforms of the speed command, the real-time torque and the amount of the dynamic unbalance during the acceleration process of the drum. With the increasing rotation speed, the torque is greatly pumped up, and the amount of the dynamic unbalance exceeds the set dynamic unbalance threshold value. It cannot continue to accelerate the drum to the high-speed phase, and it needs to stop the drum and perform the shake-disperse operation. The test result is in conformity with the design expectation.

Figure 9:
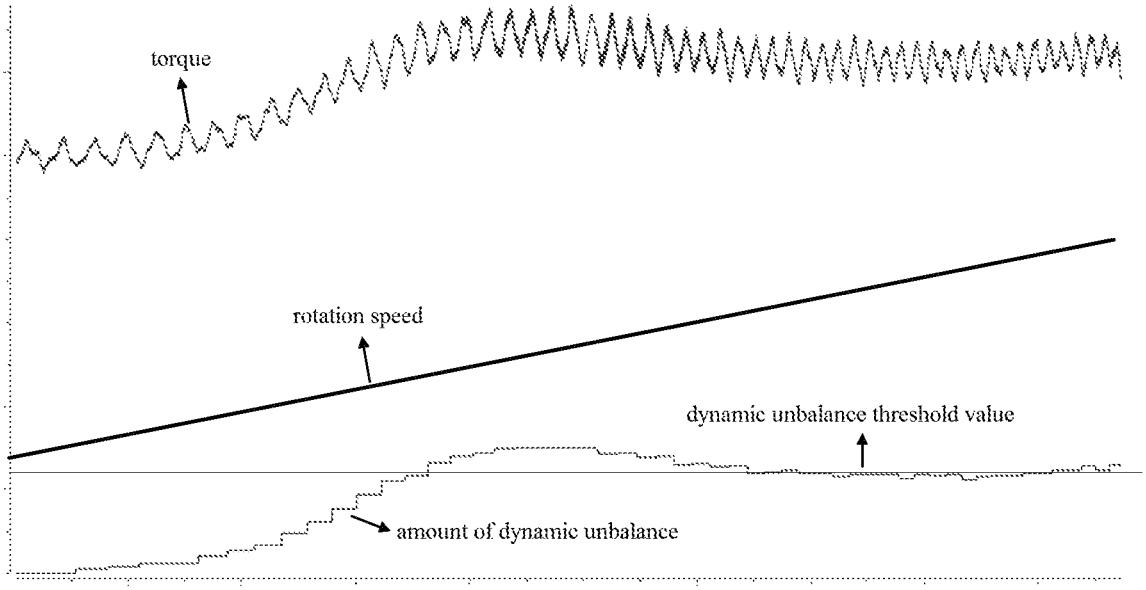
FIG. 9 is a waveform chart of variations of parameters related to an unbalance detection method for a front-loading washing machine according to embodiments of the present disclosure.

The second condition is that the drum satisfies the dynamic unbalance load state (30% averaged load, 800 g diagonal eccentricity). As shown in FIG. 9, compared with the cases of empty drum and 30% averaged load, the torque is wholly increased, however the amounts of the torques which are pumped up during the acceleration process are close to each other. With the increasing rotation speed, the torque is greatly pumped up, and the amount of the dynamic unbalance exceeds the set dynamic unbalance threshold value. It cannot continue to accelerate the drum to the high-speed phase, and it needs to stop the drum and perform the shake-disperse operation. The test result is in conformity with the design expectation.

Figure 10:
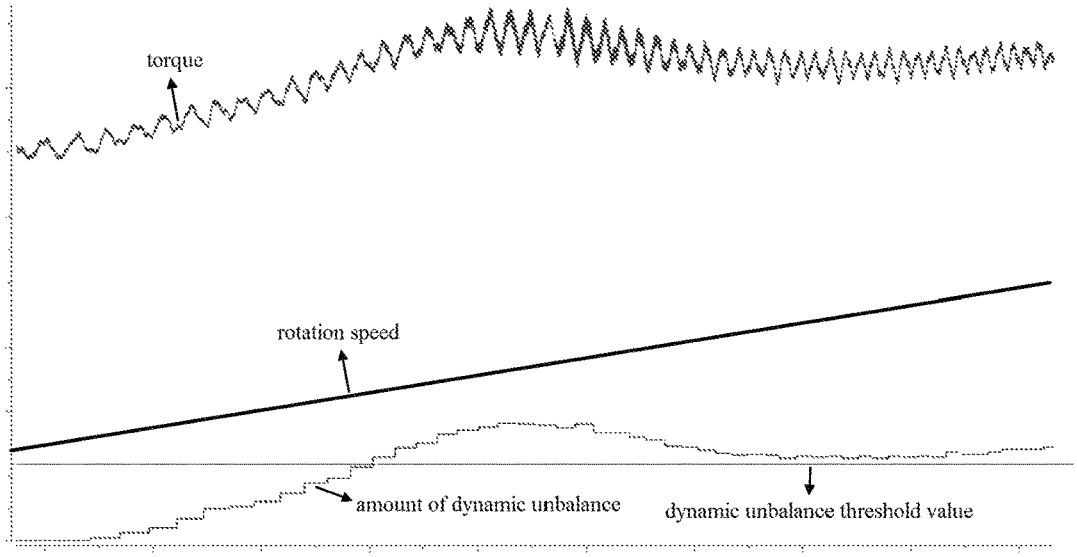
FIG. 10 is a waveform chart of variations of parameters related to an unbalance detection method for a front-loading washing machine according to embodiments of the present disclosure.

The third condition is that the drum satisfies the dynamic unbalance load state (50% averaged load, 800 g diagonal eccentricity). As shown in FIG. 10, compared with the cases of empty drum and 30% averaged load, the torque is wholly increased, however the amounts of the torques which are pumped up during the acceleration process are close to each other. With the increasing rotation speed, the torque is greatly pumped up, and the amount of the dynamic unbalance exceeds the set dynamic unbalance threshold value. It cannot continue to accelerate the drum to the high-speed phase, and it needs to stop the drum and perform the shake-disperse operation. The test result is in conformity with the design expectation.

Figure 11:
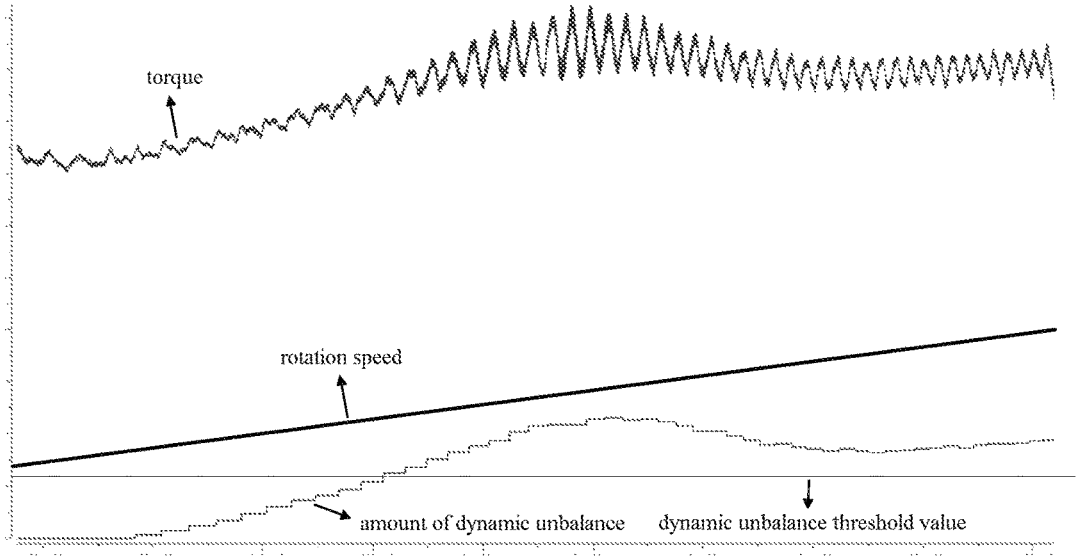
FIG. 11 is a waveform chart of variations of parameters related to an unbalance detection method for a front-loading washing machine according to embodiments of the present disclosure.

The fourth condition is that the drum satisfies the dynamic unbalance load state (50% averaged load, 800 g diagonal eccentricity). As shown in FIG. 11, compared to the cases of empty drum, 30% averaged load and 50% averaged load, the torque is wholly increased, however the amounts of the torques which are pump up during the acceleration process are close to each other. With the increasing rotation speed, the torque is greatly pumped up, and the amount of the dynamic unbalance exceeds the set dynamic unbalance threshold value. It cannot continue to accelerate the drum to the high-speed phase, and it needs to stop the drum and perform the shake-disperse operation. The test result is in conformity with the design expectation.

From the above, during the process of performing the unbalance detection of the front-loading washing machine, when the drum operates at a low constant speed and is statically balanced, the embodiments of the present disclosure detect the torque of the drum and acquire the torque average value. And then when the drum is accelerated according to the constant acceleration, the torque average value of the drum and the minimum value thereof are acquired in real time, and that whether the dynamic unbalance appears in the drum is judged according to the torque average value and the minimum value of the torque average value, if the result is yes, the drum is controlled to stop accelerative operation, meanwhile that whether the number of times of the completed shake-disperse operations is greater than the preset number of times is judged, if the result is yes, the drum is controlled to stop operating, and if the result is no, the drum is controlled to perform the shake-disperse operation and operate at the low speed subsequently, and the static unbalance detection is performed when the drum operates at the low speed. During this process, there is no need to perform the unbalance detection by a sensor, reducing the cost and detection difficulty, and the dynamic unbalance detection can be performed when the drum is in the low speed operation and the accelerative operation, avoiding the damages to the mechanical components due to collision caused by the dynamic unbalance detection when the drum operates at the high speed.

Figure 12:
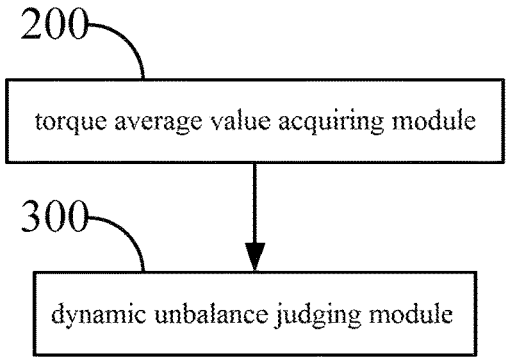
FIG. 12 is a structural view of an unbalance detection device for a front-loading washing machine according to embodiments of the present disclosure.

Based on the above-mentioned unbalance detection method for the front-loading washing machine, embodiments of the present disclosure also provide an unbalance detection device for the front-loading washing machine, as shown in FIG. 12, the unbalance detection device includes a torque average value acquiring module 200 and a dynamic unbalance judging module 300.

The torque average value acquiring module 200 is configured to detect the torque of the drum and acquire the torque average value and the minimum value of the torque average value in the period of per rotation that the drum completes, during the accelerative operation of the drum at the constant acceleration.

The dynamic unbalance judging module 300 is configured to judge whether the difference value between the torque average value and the minimum value of the torque average value is greater than the preset unbalance threshold value.

When the judging result of the dynamic unbalance judging module 300 is yes, it is determined that the dynamic unbalance appears in the drum.

When the judging result of the dynamic unbalance judging module 300 is no, it is determined that no dynamic unbalance appears in the drum.

Furthermore, the torque average value acquiring module 200 detects the torque of the drum and acquires the torque average value as follows.

The torque of the drum is detected in real time during the period of per rotation that the drum completes, and the torque average value is acquired according to a plurality of detected torque values and the time of one rotation.

Furthermore, the dynamic unbalance judging module 300 acquires the minimum value of the torque average value of the drum in real time as follows.

That whether the torque average value is greater than the prerecorded minimum value of the torque average value is judged, if the result is yes, the prerecorded minimum value of the torque average value is set as the minimum value of the torque average value, and if the result is no, the torque average value is set as the minimum value of the torque average value.

Figure 13:
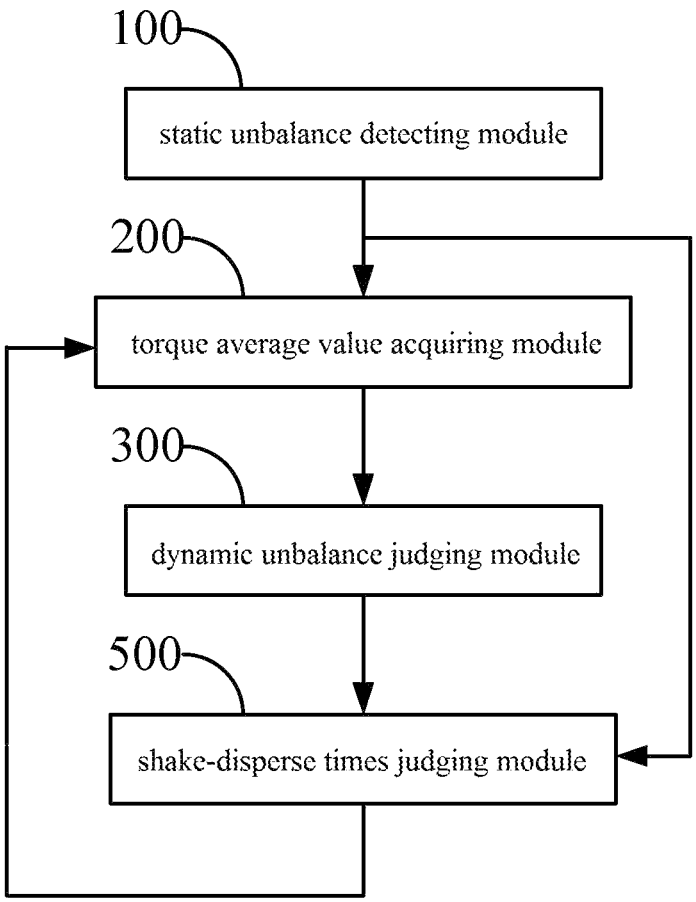
FIG. 13 is a structural view of another unbalance detection device for a front-loading washing machine according to embodiments of the present disclosure.

Furthermore, as shown in FIG. 13, the unbalance detection device for the front-loading washing machine further includes a shake-disperse times judging module 500. The shake-disperse times judging module 500 is configured to judge whether the number of times of the shake-disperse operations which have been performed by the drum is greater than the preset number of times, if the judging result is yes, the drum is controlled to stop operation, and if the judging result is no, the drum is controlled to perform the shake-disperse operation and operate at the low speed, and the torque average value acquiring module 200 is driven to work.

In addition, the unbalance detection device for the front-loading washing machine further includes a static unbalance detecting module 100. The static unbalance detecting module 100 is configured to perform the static unbalance detection of the drum when the drum operates at the low speed, that whether the static unbalance of the drum is less than the preset unbalance threshold value, if the judging result is yes, the torque average value acquiring module 200 is driven to work, and if the judging result is no, the shake-disperse times judging module 500 is driven to work.

Based on the above-mentioned unbalance detection device for the front-loading washing machine, embodiments of the present disclosure further provides a front-loading washing machine, which includes a drum and the above-mentioned unbalance detection device for the front-loading washing machine.

During the process of performing the unbalance detection on the front-loading washing machine, when the drum operates at a low constant speed, the torque average value acquiring module detects the torque of the drum and acquires the torque average value, and then when the drum is accelerated according to the constant acceleration, the dynamic unbalance judging module acquires the minimum value of the torque average value of the drum in real time, and judges whether the dynamic unbalance appears in the drum according to the torque average value and the minimum value of the torque average value, if the result is yes, a drum controlling module controls the drum to stop accelerative operation, and the shake-disperse times judging module judges whether the number of times of the shake-disperse operations having been performed by the drum is greater than the preset number of times, if the result is yes, the drum controlling module controls the drum to stop operating, and if the result is no, the drum controlling module controls the drum to perform the shake-disperse operation and operate at the low speed, and drives the static unbalance detecting module to work. During this process, no sensor is needed to perform the unbalance detection, thereby reducing the cost and detection difficulty, and the dynamic unbalance detection can be performed when the drum is in the low speed operation and the accelerative operation, thereby avoiding the damages to the mechanical components due to collision caused by the dynamic unbalance detection when the drum operates at the high speed.

The above descriptions are just preferable embodiments of the present disclosure, and are not used to limit the present disclosure, any modifications, equivalent replacements and improvements within the spirits and principles of the present disclosure should be included in the protection scope of the present disclosure.

What is claimed is:

1. An unbalance detection method for a front-loading washing machine, comprising:

during an accelerative operation of a drum of the front-loading washing machine according to a constant acceleration, detecting a plurality of torque values of the drum and acquiring a torque average value and a minimum value of the torque average value in a period of per rotation that the drum completes;

judging whether a difference value between the torque average value and the minimum value of the torque average value is greater than a preset unbalance threshold value;

in accordance with a judgment that the difference value is greater than the preset unbalance threshold value, determining that dynamic unbalance appears in the drum; and in accordance with a judgment that the difference value is not greater than the preset unbalance threshold value, determining that no dynamic unbalance appears in the drum, wherein the detecting the plurality of torque values of the drum and acquiring the torque average value in the period of per rotation that the drum completes comprises:

detecting the plurality of torque values in real time during the period of per rotation that the drum completes, and acquiring the torque average value according to the detected plurality of torque values and the time of one rotation, and wherein the detecting the plurality of torque values of the drum and acquiring the minimum value of the torque average value of the drum during the period of per rotation that the drum completes comprises:

judging whether the torque average value is greater than a predetermined minimum value, in accordance with a judgment that the torque average value is greater than the predetermined minimum value, setting the predetermined minimum value as the minimum value of the torque average value, and in accordance with a judgment that the torque average value is not greater than the predetermined minimum, setting the torque average value as the minimum value of the torque average value.

2. The method according to claim 1, after the determining that the dynamic unbalance appears in the drum, the method further comprises:

judging whether a number of times of shake-disperse operations that have previously been performed by the drum is greater than a preset number of times;

in accordance with a judgment that the number of times of the shake-disperse operations is greater than the preset number of times, controlling the drum to stop operating; and in accordance with a judgment that the number of times of the shake-disperse operations is not greater than the preset number of times, controlling the drum to perform an additional shake-disperse operation and operate at a low speed subsequently, and repeating the operation of detecting a plurality of torque values of the drum and acquiring a torque average value and a minimum value of the torque average value in a period of per rotation that the drum completes during an accelerative operation of the drum according to a constant acceleration.

3. The method according to claim 2, the method further comprises:

before the detecting the plurality of torque values of the drum and acquiring the torque average value and the minimum value of the torque average value in the period of per rotation that the drum completes, detecting a static unbalance value of the drum when the drum operates at a constant speed;

judging whether the static unbalance value of the drum is lower than the preset unbalance threshold value;

in accordance with a judgment that the static unbalance value of the drum is lower than the preset unbalance threshold value, performing the detecting the plurality of torque values of the drum and acquiring the torque average value and the minimum value of the torque average value in the period of per rotation that the drum completes; and in accordance with a judgment that the static unbalance value of the drum is not lower than the preset unbalance threshold value, performing the judging whether the number of times of shake-disperse operations that have previously been performed by the drum is greater than the preset number of times.

* * * * *